US011459153B2

(12) United States Patent
Lee

(10) Patent No.: US 11,459,153 B2
(45) **Date of Patent: *Oct. 4, 2022**

(54) SHIPPING CONTAINER FOR ROLLED GOODS

(71) Applicant: Poly-America, L.P., Grand Prairie, TX (US)

(72) Inventor: Brandon J. Lee, Chanhassen, MN (US)

(73) Assignee: Poly-America, L.P., Grand Prairie, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/477,141

(22) Filed: Sep. 16, 2021

(65) Prior Publication Data

US 2022/0089345 A1 Mar. 24, 2022

Related U.S. Application Data

(63) Continuation of application No. 17/027,156, filed on Sep. 21, 2020, now Pat. No. 11,148,862.

(51) Int. Cl.
*B65D 75/00* (2006.01)

(52) U.S. Cl.
CPC ..... *B65D 75/004* (2013.01)

(58) Field of Classification Search
CPC ..... B65D 71/00; B65D 75/00; B65D 75/004; B65D 85/67; B65D 85/671; B65D 85/672
See application file for complete search history.

(56) References Cited

U.S. PATENT DOCUMENTS 2,788,894 A * 4/1957 Shifrer ..... B65D 71/02 206/446
3,280,987 A * 10/1966 Steinbock ..... A47F 7/17 206/394
3,450,329 A * 6/1969 Goldberg ..... B65D 45/00 206/389
3,837,480 A * 9/1974 Brunett ..... B65D 75/004 206/391
5,829,592 A * 11/1998 Henry, Jr. ..... B65D 85/672 206/416
6,047,523 A * 4/2000 Eyre ..... B65B 11/025 206/391
6,805,239 B2 * 10/2004 Smarr ..... B65D 85/66 206/397
7,281,629 B2 * 10/2007 Pavlansky ..... B65D 85/672 206/413

* cited by examiner

*Primary Examiner* — Bryon P Gehman
(74) *Attorney, Agent, or Firm* — Daniel J. Layden

(57) ABSTRACT

The present invention relates to a shipping container for rolled goods, particularly relatively heavy and rigid rolled products such as high count rolls of trash bags. In at least one embodiment, the shipping container may be used for shipping a product enclosure containing a pair of rolled trash bags. The shipping container can include a pair of opposing side reinforcing trays to prevent damage to the shipping container when in transit. The invention can conserve the amount of materials used and reduce the shipping weight of the container. The shipping container can further include a flexible overwrap to maintain the reinforcement trays on the opposing side ends of the product enclosure and to provide for additional reinforcement to the shipping container.

20 Claims, 5 Drawing Sheets

SHIPPING CONTAINER FOR ROLLED GOODS

CROSS-REFERENCE TO RELATED APPLICATIONS

Figure 1A:
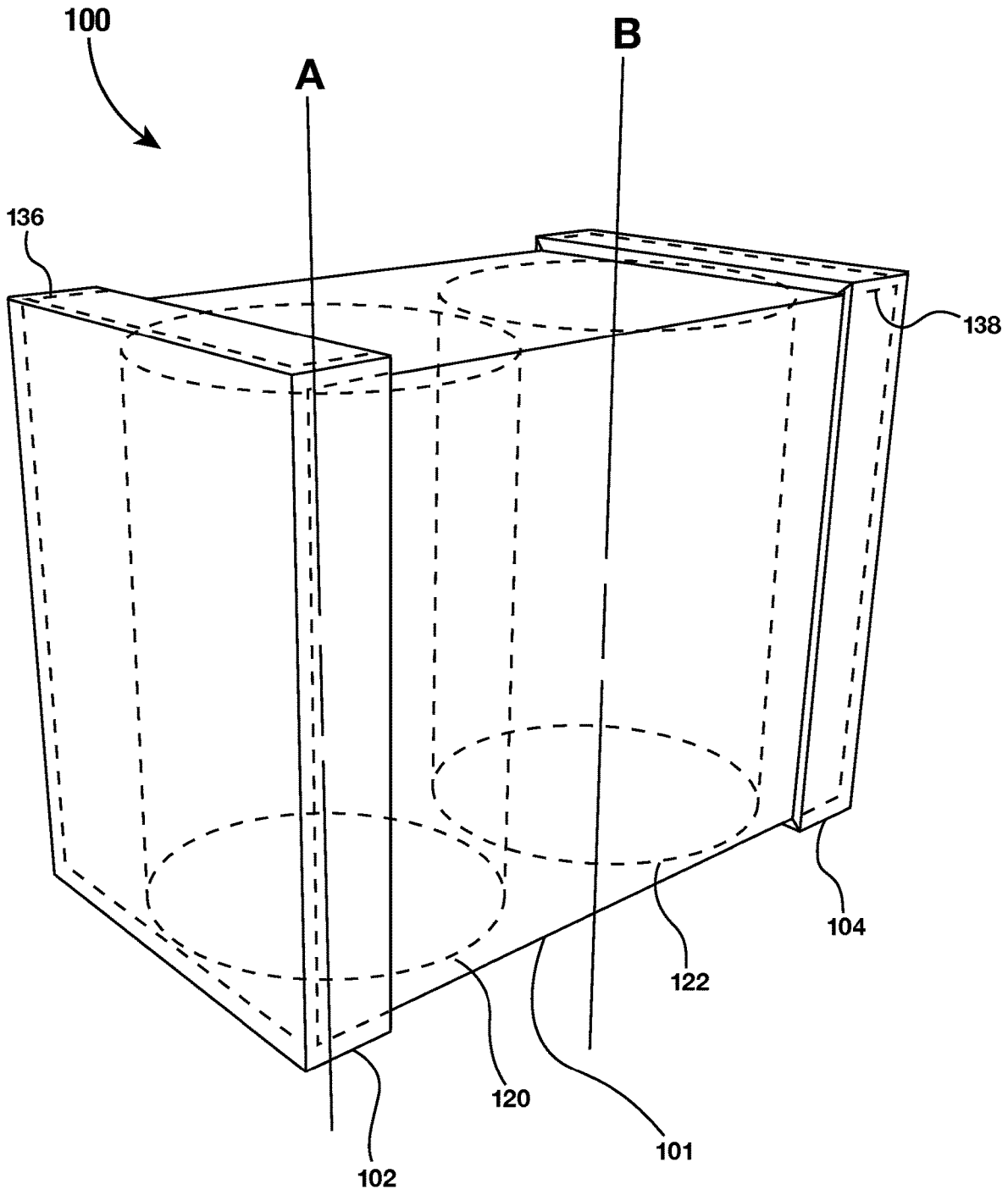

This application is a continuation of U.S. application Ser. No. 17/027,156, filed Sep. 21, 2020, and is hereby incorporated by reference into this disclosure in its entirety.

BACKGROUND OF THE INVENTION

1. Field of the Invention

The present invention relates to improvements in the construction and configuration of a shipping container for rolled goods, particularly a shipping container for product packaging containing trash bags provided in a rolled configuration.

2. Description of the Related Art

With the rise of Internet commerce, it has become more commonplace to ship individual consumer products direct from a distribution center or a manufacturer's warehouse to a consumer's home. Such products include relatively heavy and rigid rolled goods such as trash bags. Thirteen-gallon kitchen trash bags are known to be sold in a single box with a quantity of up to 200 bags, with the box typically containing two rolls, each roll containing up to 100 bags. Such a box of packaged trash bags can weigh over ten pounds. Such products are typically sold in a rectangular prismatic box constructed of corrugated cardboard. These boxes have been designed with enough strength to protect the product and maintain the integrity of the product packaging for palletizing, being shipped via a pallet, and being placed on a store shelf. However, this packaging typically does not have the necessary strength to withstand the rigors of being shipped by itself via a commercial courier to a consumer's home.

Rolled goods such as trash bags are relatively heavy; however, they are also relatively stiff and rigid. With such rolled goods being generally cylindrical in shape, the goods, having a certain amount of stiffness, help to reinforce and support the container where the rolled goods are in contact with the product enclosure. However, the relatively stiff rolled goods fail to make contact with the corners of the product packaging; therefore, the corners of the typical rectangular shaped product enclosure have a tendency to become damaged if such enclosure is shipped by itself in its packaging typically used for sale at retail. Therefore, it would be advantageous to provide novel methods to reinforce existing retail packaging for rolled goods such as trash bags to enable a reliable and economical means of shipping such goods directly to a consumer.

In view of the considerations discussed above, the invention disclosed herein is particularly advantageous when rolled goods packaged in a rectangular box are shipped. The following disclosure addresses such invention in detail.

SUMMARY OF THE INVENTION

The present invention comprises a shipping container for one or more rolled goods. In certain embodiments of the present invention the shipping container can comprise a product enclosure. The product enclosure can comprise opposing vertical first and second side panels, opposing vertical front and rear panels, and opposing horizontal top and bottom panels. At least a first rolled good can be enclosed within the product enclosure. The first rolled good can be rolled about a first vertical axis to form a generally cylindrical shape. A generally flat top of the first rolled good can support the top panel and a generally flat bottom of the first rolled good can rest on the bottom panel.

The shipping container can further comprise a first reinforcing tray. The first reinforcing tray can comprise opposing horizontal top and bottom walls, opposing vertical front and rear walls, and a vertical outer wall at first ends of the top, bottom, front, and rear walls. The outer wall can extend between the top and bottom walls and between the front and rear walls. An opening can extend between opposite second ends of the first end of the top, bottom, front, and rear walls. The first reinforcing tray can receive a first side end of the product enclosure through its opening, wherein the first side end comprises the first side panel and a partial width of the front and rear panels and a partial width of the top and bottom panels of the product enclosure. Additionally, a flexible outer wrap can be placed around an outer surface of the first reinforcing tray. The flexible outer wrap can encapsulate the product enclosure and the first reinforcing tray.

In certain embodiments of the present invention, the product enclosure of the shipping container may comprise a rectangular prism and the first reinforcing tray may comprise a rectangular vessel. Furthermore, the flexible outer wrap may comprise a single continuous web of polymeric film. In additional embodiments, the flexible outer wrap may comprise more than one web of polymeric film. The flexible outer wrap may also comprise shrink wrap film. The shrink wrap film may be in intimate contact with the first reinforcing tray and the product enclosure. Furthermore, in certain embodiments the flexible outer wrap may have a perforation in it to assist the recipient of the shipping container in removing the container from the product enclosure.

Additionally, in certain embodiments of the present invention, the shipping container may comprise a second reinforcing tray. The second reinforcing tray may comprise opposing horizontal top and bottom walls, opposing vertical front and rear walls, and a vertical outer wall at first ends of the top, bottom, front, and rear walls. An outer wall of the second reinforcing tray may extend between the top and bottom walls and between the front and rear walls. An opening may extend between second opposite ends of the top, bottom, front, and rear walls. The second reinforcing tray may receive a second side end of the product enclosure with the second side end opposite from the first side end. The second side end may comprise the second side panel and a partial width of the front and rear panels and partial widths of the top and bottom panels of the product enclosure. The flexible outer wrap of the shipping container may be placed around an outer surface of the second reinforcing tray and encapsulate the second reinforcing tray with the first reinforcing tray and the product enclosure.

The shipping container may further comprise a second rolled good within the product enclosure. The second rolled good may be rolled about a second vertical axis to form a generally cylindrical shape. A generally flat top of the second rolled good may support the top panel and a generally flat bottom of the second rolled good may rest on the bottom panel. Additionally, the product enclosure of shipping container may comprise corrugated cardboard. The first and second reinforcement trays may also comprise corrugated cardboard. The corrugated cardboard of the reinforcement trays may be of equal or greater thickness than the corrugated cardboard of the product enclosure. Rather than corrugated cardboard or some other material, the first and second reinforcement trays may comprise a generally rigid polymeric material.

While the present invention is applicable to a variety of products in a roll configuration, in certain embodiments of the present invention, the at least one rolled good is a roll of trash bags. Moreover, in some specific embodiments, the at least one rolled good may be a coreless roll of trash bags.

It is contemplated that the present invention may be utilized in ways that are not fully described or set forth herein. The present invention is intended to encompass these additional uses to the extent such uses are not contradicted by the appended claims. Therefore, the present invention should be given the broadest reasonable interpretation in view of the present disclosure, the accompanying figures, and the appended claims.

BRIEF DESCRIPTION OF THE RELATED DRAWINGS

A full and complete understanding of the present invention may be obtained by reference to the detailed description of the present invention and certain embodiments when viewed with reference to the accompanying drawings. The drawings can be briefly described as follows.

FIG. 1A provides a perspective view of an embodiment of the present invention without the flexible overwrap shown.

Figure 1B:
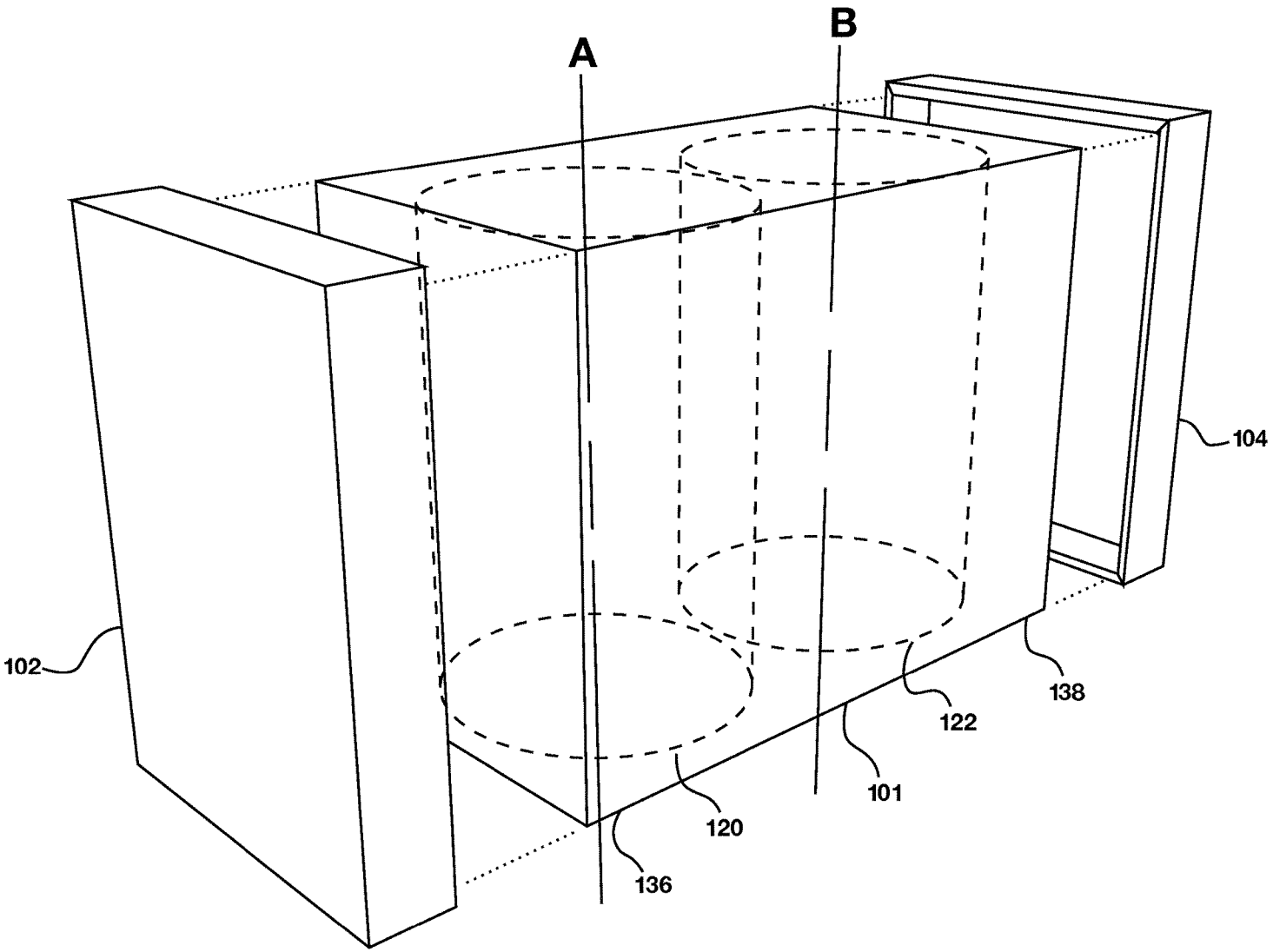

FIG. 1B provides an exploded view of the embodiment of FIG. 1A.

Figure 2:
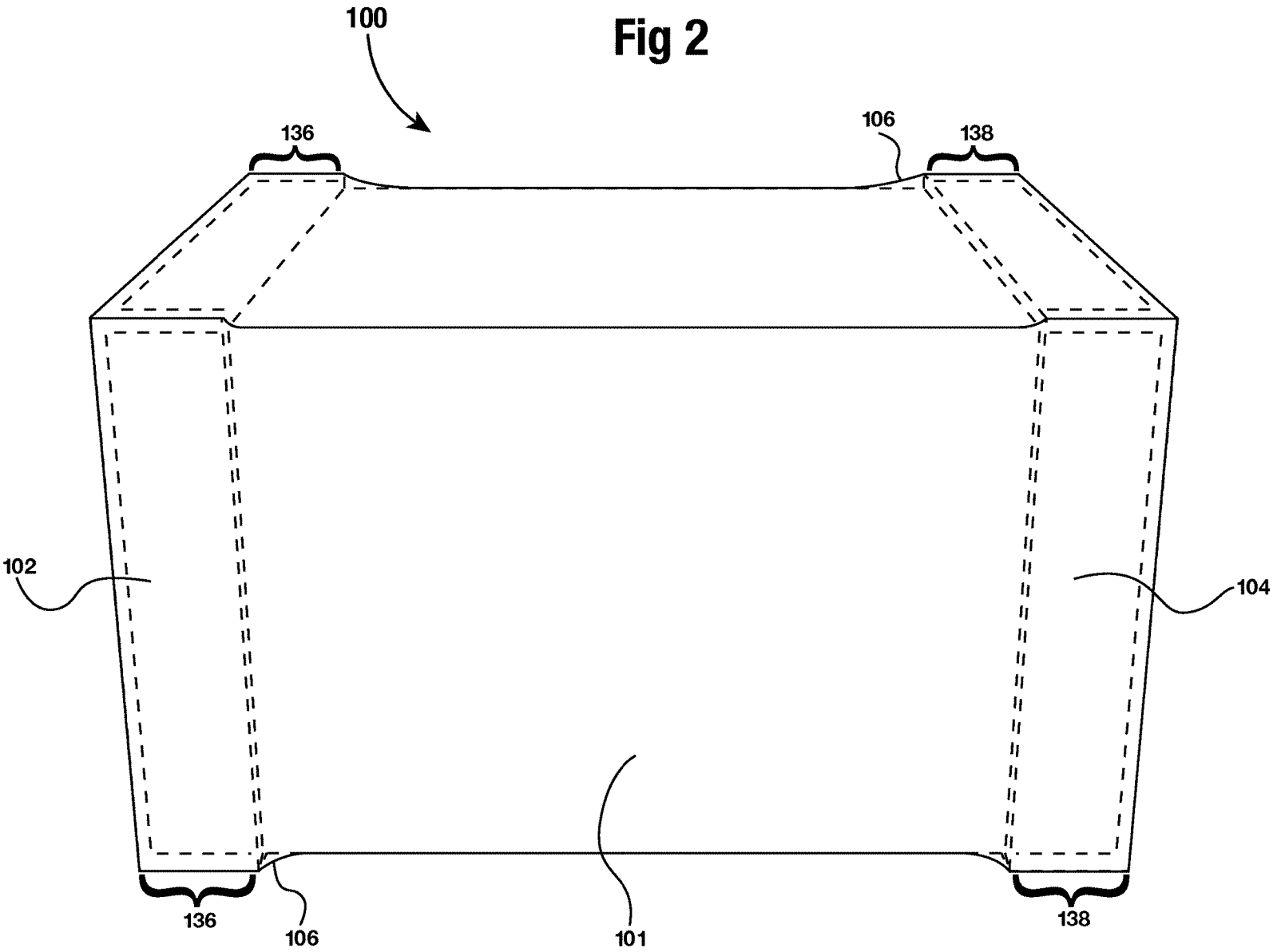

FIG. 2 provides a front perspective view of the embodiment of FIG. 1A with the flexible overwrap shown.

Figure 3:
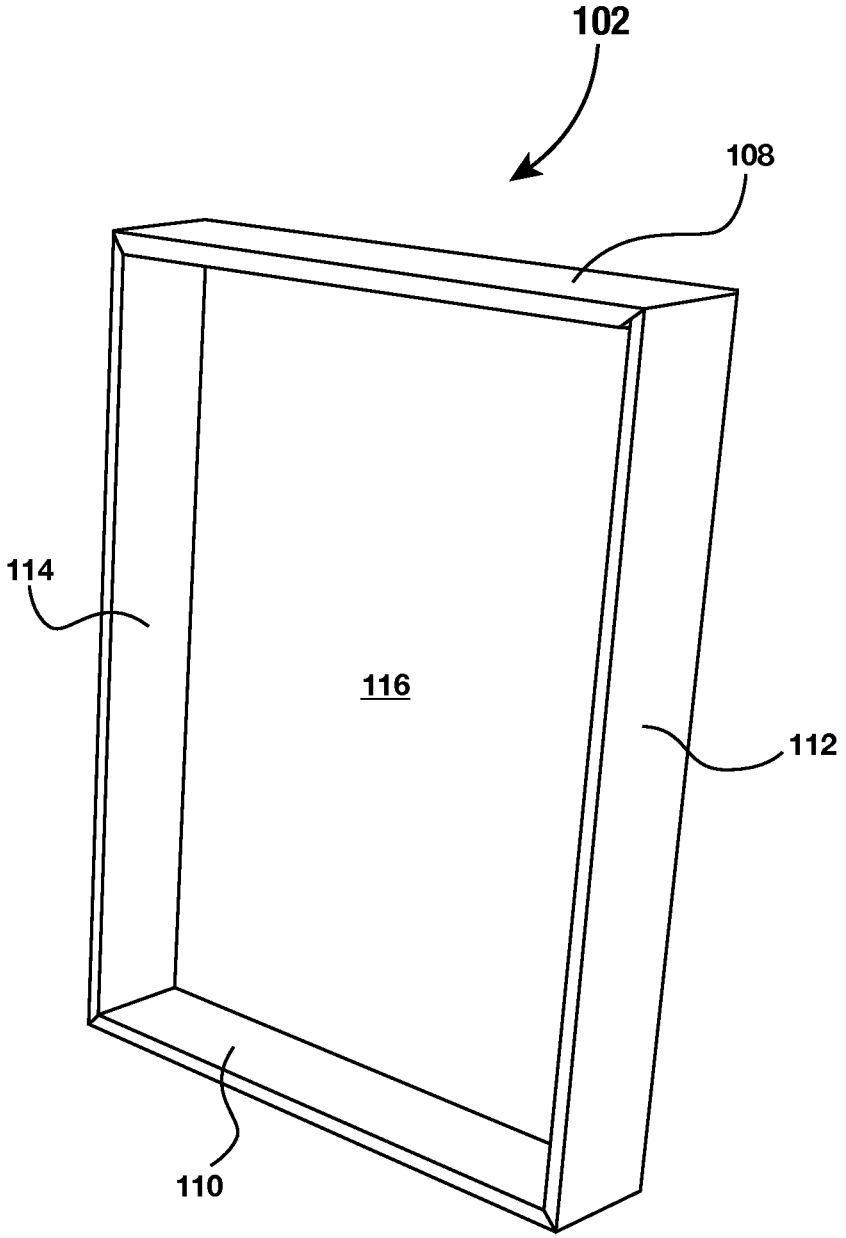

FIG. 3 provides a perspective view of a reinforcement tray of the embodiment of FIG. 1A.

Figure 4:
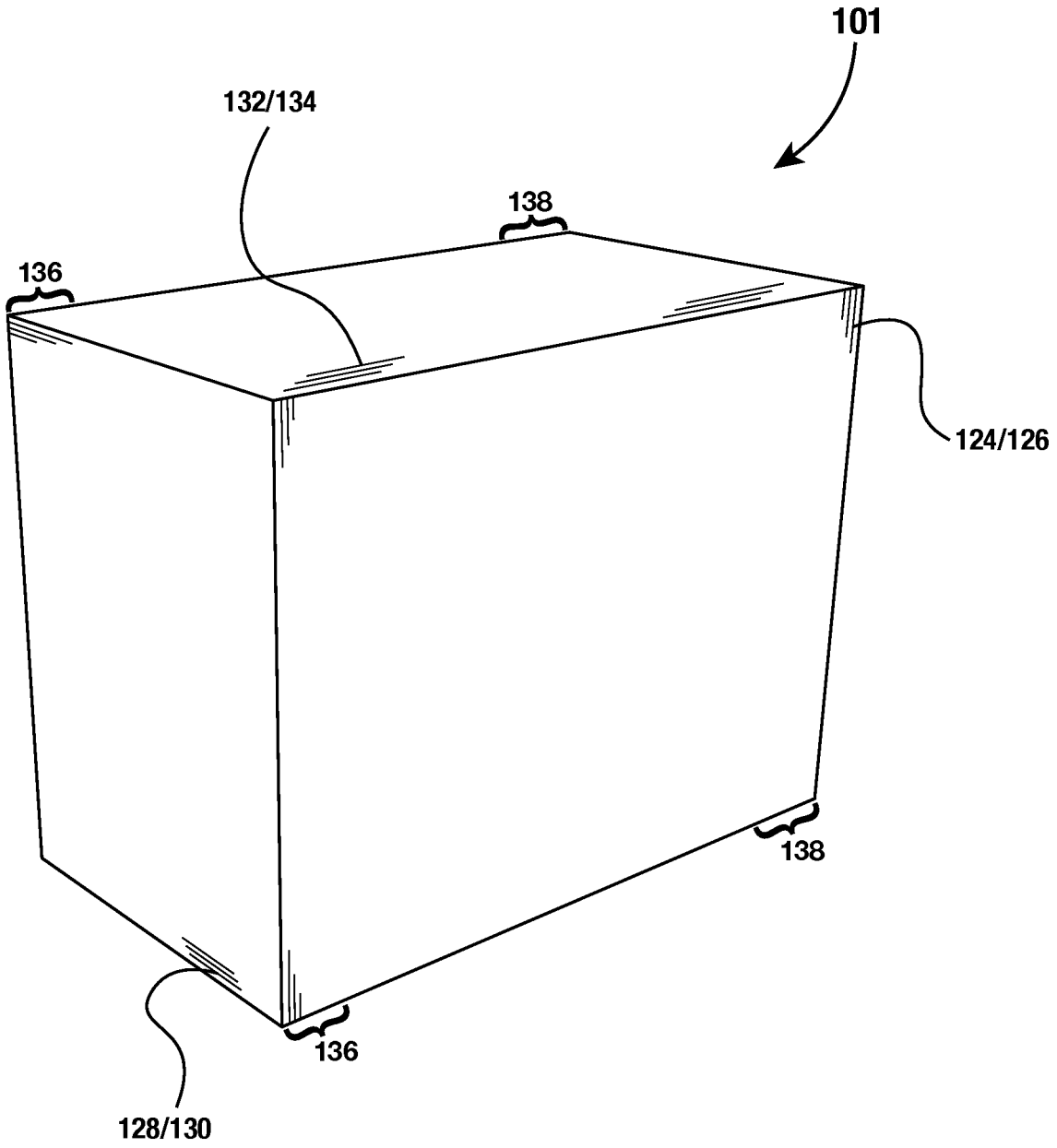

FIG. 4 provides a perspective view of a product enclosure of the embodiment of FIG. 1A.

DETAILED DESCRIPTION OF THE INVENTION

The present disclosure illustrates several embodiments of the present invention. It is not intended to provide an illustration or encompass all embodiments contemplated by the present invention. In view of the disclosure of the present invention contained herein, a person having ordinary skill in the art will recognize that innumerable modifications and insubstantial changes may be incorporated or otherwise included within the present invention without diverging from the spirit of the invention. Therefore, it is understood that the present invention is not limited to those embodiments disclosed herein. The appended claims are intended to more fully and accurately encompass the invention to the fullest extent possible, but it is fully appreciated that certain limitations on the use of particular terms are not intended to conclusively limit the scope of protection.

Referring initially to FIGS. 1A and 1B, perspective and exploded views of an embodiment of the present invention are disclosed. As shown in the figures, shipping container 100 includes product enclosure 101 and first and second reinforcement trays 102 and 104. Trays 102 and 104 surround first and second opposing side end sections 136 and 138 of product enclosure 101. A pair of rolled goods or products 120 and 122 are shown within product enclosure 101. In further embodiments of the present invention, only a single rolled good may be placed within product enclosure 101; additionally, more than two rolled goods may be placed in product enclosure 101. Rolled goods 120 and 122 are shown in the figures rolled about the respective first and second central axes A and B.

Now briefly turning to FIG. 2, flexible outer wrap 106 is shown encapsulating product enclosure 101 and trays 102 and 104 as part of shipping container 100. Note that only certain features of container 100 are illustrated in FIG. 2 for purposes of clarity. Wrap 106 serves as the outer walls of shipping container 100. In certain embodiments, wrap 106 may extend over only a portion of trays 102 and 104 and product enclosure 101. Whether wrap 106 partially or fully encapsulates trays 102 and 104 and product enclosure 101, it maintains trays 102 and 104 positioned over opposing side end sections 136 and 138 of product enclosure 101.

In certain embodiments, product enclosure 101 and first and second reinforcement trays 102 and 104 are made using the same material, such as a rigid cardboard material including paperboard, chipboard, or corrugated fiberboard. However, in other embodiments, the reinforcement trays 102 and 104 may be made with distinct materials from the product enclosure 101, which may be selected from any suitable material including, but not limited to, rigid polymers. The specific material selection is driven by the need to provide sufficient rigidity for the shipping container 100 as a whole based upon the expected utilization and the various conditions container 100 may be subjected to when being shipped by commercial couriers such as the United States Postal Service, Federal Express, and UPS, from a product distribution center or warehouse to a consumer.

In certain embodiments, flexible outer wrap 106 is a polymer film, particularly a shrink-wrap or shrink film. When flexible outer wrap 106 is a heat-activated shrink-wrap material, the flexible outer wrap 106 can be shrunk to surround at least a portion or all of the top panel 102 and bottom panel 104. The force of the shrunken flexible outer wrap keeps the reinforcement trays 102 and 104 in close contact with product enclosure 101. As seen in the depicted embodiment, the flexible outer wrap 106 completely surrounds and encapsulates the assembly of product enclosure 101 and reinforcement trays 102 and 104. Thus, in the depicted embodiment, the shrink-wrap flexible outer wrap 106 securely sandwiches product enclosure 101 between the first and second reinforcement trays 102 and 104.

In certain embodiments of the present invention, the flexible outer wrap 106 can comprise a single continuous web of polymeric film. In further embodiments, the flexible outer wrap 106 can comprise more than one web of polymeric film. Additionally, the flexible outer wrap 106 can have a perforation in it to assist the recipient of the shipping container 100 in removing the wrap 106 from shipping container 100 and product enclosure 101. The perforation can extend from the first reinforcement tray 102 to the second reinforcement tray 104. In further embodiments, the perforation can extend in general from a top to a bottom of shipping container 100.

Use of reinforcement trays 102 and 104 for the shipping of heavy rolled goods 120, 122, such as coreless rolls of trash bags, is particularly advantageous with respect to the present invention. Rolled goods are not square or rectangular, but rather are generally cylindrical in shape. Traditional cardboard packaging is generally a rectangular prism, resulting in unsupported space in the corners of the container when enclosing cylindrical rolled goods. The rolled goods help to reinforce and support the container where the rolled goods are in contact with the product enclosure. However, with the relatively stiff rolled goods not making contact with the corners of the product packaging, reinforcement trays can provide adequate strength to these sections of the packaging while conserving the use of material versus the use of an overall thicker product enclosure. Additionally, use of a heavy duty flexible overwrap serves to maintain reinforcement trays on the product enclosure 101 and further reinforce shipping container 100 from damage.

As mentioned above, the present invention is advantageous when used with certain rolled goods such as coreless rolled trash bags. Such goods provide strength and rigidity in one or more directions. Tightly rolled, larger rolls of trash bags are generally rigid along the perimeter of the cylindrical roll, i.e. it is difficult to indent the roll of trash bags along the cylindrical wall when pushed toward the central axis of the roll. Additionally, a roll of trash bags when placed upright, i.e. the central axis running up and down, is capable of supporting a great deal of weight in the vertical direction. Thus, the addition of reinforcement trays 102 and 104 provide for additional shipping container strength where needed while minimizing use of materials for the shipping container.

As best shown by FIG. 1B, corresponding first and second reinforcement trays 102 and 104 receive opposing first and second end sections 136 and 138 of product enclosure 101. Rolled goods 120, 122, such as one or more rolls of trash bags, are shown placed with their axes in a vertical orientation within product enclosure 102. After reinforcement trays 102 and 104 are assembled onto opposing ends of product enclosure 101; the outer wrap 106 can be placed around trays 102 and 104 (as shown in FIG. 2) and enclosure 101. In the depicted embodiment, the flexible outer wrap 106 is a shrink-wrap and heat is applied by hand or with a heat tunnel to shrink the flexible outer wrap 106, thus providing the complete shipping container illustrated in FIG. 2.

Now turning to FIG. 3, a perspective view of the first reinforcement tray 102 is shown. Second reinforcement tray 104 is not shown because in at least certain embodiments the two trays have identical structure and only differ in their orientation and placement about product enclosure 101. In the embodiment of FIG. 3, tray 102 comprises a rectangular vessel. FIG. 3 shows tray 102 with opposing horizontal top and bottom walls 108 and 110 extending from vertical outer wall 116. Tray 102 also has vertical front and rear walls 112 and 114 extending from vertical outer wall 116. As shown, first ends of walls 108, 110, 112, and 114 are attached to outer wall 116. Opposing distal second ends of walls 108, 110, 112 and 114 define an opening between walls 108, 110, 112, and 114 for receiving one of the end sections of product enclosure 101.

FIG. 4 provides a perspective view of an embodiment of product enclosure 101. In at least the embodiment shown in FIG. 4, product enclosure is a simple rectangular prism. FIG. 4 shows product enclosure 101 having opposing vertical first and second side panels 128 and 130, opposing vertical front and rear panels 124 and 126, and opposing horizontal top and bottom panels 132 and 134. With product enclosure 101 having the shape of a rectangular prism, only a single perspective of it is shown in the drawings. Rear panel 126 is on an opposite side of enclosure 101 from front panel 124, bottom panel 134 is on an opposite of the enclosure from top panel 132, and second side panel 130 is on an opposite side of the enclosure from first side panel 128.

FIG. 4 further shows a first end section 136 of product enclosure 101 with the first end section comprising a first partial width of top and bottom panels 132 and 134, a first partial width front and rear panels 124 and 126 and the entirety of first side panel 128. In a similar fashion, second end section 138 of enclosure 101 comprises a second partial width of top and bottom panels 132 and 134, a second partial width of front and rear panels 124 and 126 and the entirety of second side panel 130.

In at least certain embodiments of the present invention, first and second end sections 136 and 138 can have a length of approximately a ⅛ width of product enclosure 101. Furthermore, in one particular example, product enclosure 101 can have a width of approximately 12 inches, a height of approximately nine inches and a depth of approximately 6.5 inches. With such dimensions, first and second end sections 136 and 138 have a length of approximately 1.5 inches.

The specific embodiments depicted herein are not intended to limit the scope of the present invention. Indeed, it is contemplated that any number of different embodiments may be utilized without diverging from the spirit of the invention. Therefore, the appended claims are intended to more fully encompass the full scope of the present invention.

I claim:

1. A shipping container comprising:

a product enclosure, the product enclosure comprising opposing vertical first and second side panels, opposing vertical front and rear panels, and opposing horizontal top and bottom panels, at least a first rolled good within the product enclosure, a top of the first rolled good supporting the top panel and a bottom of the first rolled good resting on the bottom panel, a first reinforcing tray, the first reinforcing tray comprising:

opposing horizontal top and bottom walls, opposing vertical front and rear walls, a vertical outer wall extending between first ends of the top, bottom, front, and rear walls, and an opening extending between opposing second ends of the top, bottom, front, and rear walls, and the first reinforcing tray receiving a first side end of the product enclosure, wherein the first side end comprises the first side panel and a first partial width of the top and bottom panels of the product enclosure.

2. The shipping container of claim 1, wherein:

a flexible outer wrap is placed around an outer surface of the first reinforcing tray such that it encapsulates the product enclosure and the first reinforcing tray.

3. The shipping container of claim 2, wherein:

the first reinforcing tray comprises a rectangular vessel and the product enclosure comprises a rectangular prism.

4. The shipping container of claim 3, wherein:

the top and bottom of the at least one rolled good are generally flat, and the flexible outer wrap is a single continuous web of polymeric film.

5. The shipping container of claim 4, wherein:

the flexible outer wrap comprises shrink wrap film and the shrink wrap film is in intimate contact with the first reinforcing tray and the product enclosure.

6. The shipping container of claim 5 further comprising:

a second reinforcing tray, the second reinforcing tray comprising:

opposing horizontal top and bottom walls, opposing vertical front and rear walls, a vertical outer wall extending between first ends of the top, bottom, front, and rear walls, and an opening extending between opposing second ends of the top, bottom, front, and rear walls, the second reinforcing tray receiving a second side end of the product enclosure, the second side end opposite from the first side end, wherein the second side end comprises the second side panel and a second partial width of the front and rear panels and a second partial width of the top and bottom panels of the product enclosure.

7. The shipping container of claim 6 further comprising:

the flexible outer wrap placed around an outer surface of the second reinforcing tray and encapsulating the second reinforcing tray with the first reinforcing tray and the product enclosure.

8. The shipping container of claim 7 further comprising:

a second rolled good within the product enclosure, the second rolled good oriented about a second vertical axis and having a generally cylindrical shape, a generally flat top of the second rolled good supporting the top panel and a generally flat bottom of the second rolled good resting on the bottom panel.

9. The shipping container of claim 8 wherein:

the product enclosure comprises corrugated cardboard.

10. The shipping container of claim 9 wherein:

the first and second reinforcement trays comprise corrugated cardboard of equal or greater thickness than the corrugated cardboard of the product enclosure.

11. A shipping container comprising:

a product enclosure, the product enclosure comprising opposing vertical first and second side panels, opposing vertical front and rear panels, and opposing horizontal top and bottom panels, at least a pair of rolled goods with corresponding outer walls proximate to each other within the product enclosure, the rolled goods oriented about first and second vertical axes, each rolled good having top and bottom surfaces, the top surfaces of the pair of rolled goods supporting the top panel and the bottom surfaces of the pair of rolled goods resting on the bottom panel, a first reinforcing tray, the first reinforcing tray comprising:

opposing horizontal top and bottom walls, opposing vertical front and rear walls, a vertical outer wall extending between first ends of the top, bottom, front, and rear walls, and an opening extending between opposing second ends of the top, bottom, front, and rear walls, the first reinforcing tray receiving a first side end of the product enclosure, wherein the first side end comprises the first side panel and a first partial width of the front and rear panels of the product enclosure.

12. The shipping container of claim 11 wherein:

the product enclosure comprises a rectangular prism and the first reinforcing tray comprises a rectangular vessel.

13. The shipping container of claim 12 wherein:

a flexible outer wrap is placed around an outer surface of the first reinforcing tray such that it encapsulates the product enclosure and the first reinforcing tray.

14. The shipping container of claim 13 wherein:

the flexible outer wrap is a single continuous web of polymeric film.

15. The shipping container of claim 14 wherein:

the flexible outer wrap comprises shrink wrap film, the shrink wrap film in intimate contact with the first reinforcing tray and the product enclosure.

16. The shipping container of claim 15 further comprising:

a second reinforcing tray, the second reinforcing tray comprising:

opposing horizontal top and bottom walls, opposing vertical front and rear walls, a vertical outer wall extending between first ends of the top, bottom, front, and rear walls, and an opening extending between opposing second ends of the top, bottom, front, and rear walls, the second reinforcing tray receiving a second side end of the product enclosure, the second side end opposite from the first side end, wherein the second side end comprises the second side panel and a second partial width of the front and rear panels and a second partial width of the top and bottom panels of the product enclosure.

17. The shipping container of claim 16 further comprising:

the flexible outer wrap placed around an outer surface of the second reinforcing tray and encapsulating the second reinforcing tray with the first reinforcing tray and the product enclosure.

18. The shipping container of claim 17 wherein:

the product enclosure comprises corrugated cardboard.

19. The shipping container of claim 18 wherein:

the first and second reinforcement trays comprise corrugated cardboard.

20. The shipping container of claim 17 wherein:

the first and second reinforcement trays comprise a generally rigid polymeric material.

* * * * *